US010109291B2

(12) United States Patent
Hirohata et al.

(10) Patent No.: US 10,109,291 B2
(45) Date of Patent: Oct. 23, 2018

(54) NOISE SUPPRESSION DEVICE, NOISE SUPPRESSION METHOD, AND COMPUTER PROGRAM PRODUCT

(71) Applicant: KABUSHIKI KAISHA TOSHIBA, Tokyo (JP)

(72) Inventors: Makoto Hirohata, Kanagawa (JP); Yusuke Kida, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 168 days.

(21) Appl. No.: 15/390,169

(22) Filed: Dec. 23, 2016

(65) Prior Publication Data

US 2017/0194018 A1 Jul. 6, 2017

(30) Foreign Application Priority Data

Jan. 5, 2016 (JP) ..... 2016-000494

(51) Int. Cl.
*G10L 21/0208* (2013.01)
*G10L 21/0232* (2013.01)
(Continued)

(52) U.S. Cl.
CPC ..... *G10L 21/0232* (2013.01); *G10L 21/0208* (2013.01); *G10L 21/0388* (2013.01); *G10L 25/57* (2013.01)

(58) Field of Classification Search
USPC ..... 704/226
See application file for complete search history.

(56) References Cited

U.S. PATENT DOCUMENTS 8,515,098 B2 8/2013 Liu
8,724,828 B2 * 5/2014 Furuta ..... H04R 3/002 327/551
(Continued)

FOREIGN PATENT DOCUMENTS

JP 4423300 3/2010
JP 2010-102199 5/2010
(Continued)

OTHER PUBLICATIONS

Fujimoto, M. et al, (2002), "Speech Recognition under Noisy Environments Using Speech Signal Estimation Method Based on Kalman Filter," *Institute of Electronics, Information and Communication Engineers,* vol. J85-D-II, No. 1, pp. 1-11.

*Primary Examiner* — Richemond Dorvil
*Assistant Examiner* — Thuykhanh Le
(74) *Attorney, Agent, or Firm* — Finnegan, Henderson, Farabow, Garrett & Dunner, L.L.P.

(57) ABSTRACT

A noise suppression device includes an estimating unit that estimates, from a feature quantity representing the feature in each frequency range of a first acoustic signal which represents sound, the noise component of the feature quantity; a calculating unit that calculates, from the feature quantity and the noise component for each frequency range, a first suppression coefficient to be used in suppressing noise included in the first acoustic signal; a first attenuating unit that attenuates the first suppression coefficient in the time domain and calculates a second suppression coefficient; a second attenuating unit that attenuates the second suppression coefficient in the frequency domain and calculates a third suppression coefficient; and a generating unit that estimates, from the feature quantity and the third suppression coefficient, a voice component of the feature quantity
(Continued)

and generates a second acoustic signal in which the noise included in the first acoustic signal is suppressed.

9 Claims, 8 Drawing Sheets

(51) Int. Cl.
*G10L 21/0388* (2013.01)
*G10L 25/57* (2013.01)

(56) References Cited

U.S. PATENT DOCUMENTS

2007/0027685 A1* 2/2007 Arakawa ..... G10L 21/0208 704/226
2007/0232257 A1* 10/2007 Otani ..... G10L 21/0208 455/403
2008/0192956 A1* 8/2008 Kazama ..... G10L 21/0208 381/94.3
2008/0247569 A1* 10/2008 Kondo ..... G10L 21/0208 381/94.2
2010/0008520 A1* 1/2010 Saruwatari ..... G10L 21/0208 381/94.2
2010/0104113 A1* 4/2010 Liu ..... G10L 21/0208 381/94.2
2010/0119079 A1* 5/2010 Kim ..... G10L 21/0208 381/94.1
2010/0260354 A1* 10/2010 Ozawa ..... G10L 21/0208 381/94.4
2011/0022383 A1* 1/2011 Jung ..... G10L 21/0208 704/226
2011/0211711 A1* 9/2011 Inoue ..... G10L 21/02 381/94.3
2013/0035933 A1* 2/2013 Hirohata ..... G10L 15/20 704/206
2013/0117016 A1* 5/2013 Ruwisch ..... G10L 21/0208 704/225
2013/0166286 A1* 6/2013 Matsumoto ..... G10L 21/02 704/205
2014/0122068 A1* 5/2014 Hirohata ..... G10L 21/0272 704/233
2014/0177868 A1* 6/2014 Jensen ..... H04R 3/002 381/94.7
2014/0180685 A1* 6/2014 Ono ..... G10L 21/0272 704/233
2014/0200886 A1* 7/2014 Matsumoto ..... G10L 21/0208 704/226
2015/0088494 A1* 3/2015 Matsumoto ..... G10L 21/0232 704/205
2015/0189432 A1* 7/2015 Yuzuriha ..... H04R 3/00 381/94.1
2015/0271439 A1* 9/2015 Okano ..... G10L 21/0232 381/71.14
2015/0356983 A1* 12/2015 Tsujikawa ..... G10L 21/0208 704/226
2016/0072997 A1* 3/2016 Tsujimoto ..... H04N 5/232 367/197
2016/0133269 A1* 5/2016 Dusan ..... G10L 21/0208 704/233
2016/0162469 A1* 6/2016 Santos ..... G10L 15/22 704/10

FOREIGN PATENT DOCUMENTS

JP 2010-102201 5/2010
JP 2010-102204 5/2010
JP 2013-037152 2/2013
JP 2014-089420 5/2014
JP 2015-64602 4/2015
JP 2015-143811 8/2015
WO WO-2012/098579 7/2012

* cited by examiner

NOISE SUPPRESSION DEVICE, NOISE SUPPRESSION METHOD, AND COMPUTER PROGRAM PRODUCT

CROSS-REFERENCE TO RELATED APPLICATIONS

This application is based upon and claims the benefit of priority from Japanese Patent Application No. 2016-000494, filed on Jan. 5, 2016; the entire contents of which are incorporated herein by reference.

FIELD

Embodiments described herein relate generally to a noise suppression device, a noise suppression method, and a computer program product.

BACKGROUND

During voice recognition or video production, the sound is obtained using a microphone and is converted into acoustic signals. The acoustic signals output from the microphone not only include voice signals representing the voice of a user but also include the background sound (noise), which is flowing in the background, in the form of noise signals. As the technology for suppressing noise signals from acoustic signals (input signals) that include a mix of voice signals and noise signals, the noise suppression technology is conventionally known.

Examples of the conventional noise suppression technology include the spectral subtraction method and the Wiener filtering method. The spectral subtraction method represents the noise suppression technology in which the average spectrum of non-voice sections is assumed to be the noise estimation value and the value obtained by subtracting the noise estimation value from the spectrum of input signals is set as the post-noise-suppression spectrum. The Wiener filtering method represents the noise suppression technology in which, from the ratio of the post-noise-suppression spectrum and the spectrum of input signals, a noise suppression coefficient to be used in suppressing the noise signals from the input signals is derived, and noise suppression signals are obtained by multiplying the input signals by the noise suppression coefficient.

However, in the conventional noise suppression technology, if there is a large error between the actual noise included in input signals and the noise estimation value or if there is a large variation in the noise suppression coefficients, sometimes the noise component gets excessively suppressed or sometimes the noise component does not get sufficiently suppressed. That is, in the conventional noise suppression technology, there are times when the output sound is deteriorated due to the generation of musical noise or due to unnaturalness of the sound.

DETAILED DESCRIPTION

According to one embodiment, a noise suppression device includes an estimating unit that estimates, from a feature quantity representing the feature in each frequency range of a first acoustic signal which represents sound, the noise component of the feature quantity; a calculating unit that calculates, from the feature quantity and the noise component for each frequency range, a first suppression coefficient to be used in suppressing noise included in the first acoustic signal; a first attenuating unit that attenuates the first suppression coefficient in the time domain and calculates a second suppression coefficient; a second attenuating unit that attenuates the second suppression coefficient in the frequency domain and calculates a third suppression coefficient; and a generating unit that estimates, from the feature quantity and the third suppression coefficient, a voice component of the feature quantity and generates a second acoustic signal in which the noise included in the first acoustic signal is suppressed.

Exemplary embodiments of a noise suppression device, a noise suppression method, and a computer program product are described below in detail with reference to the accompanying drawings.

First Embodiment

Figure 1:
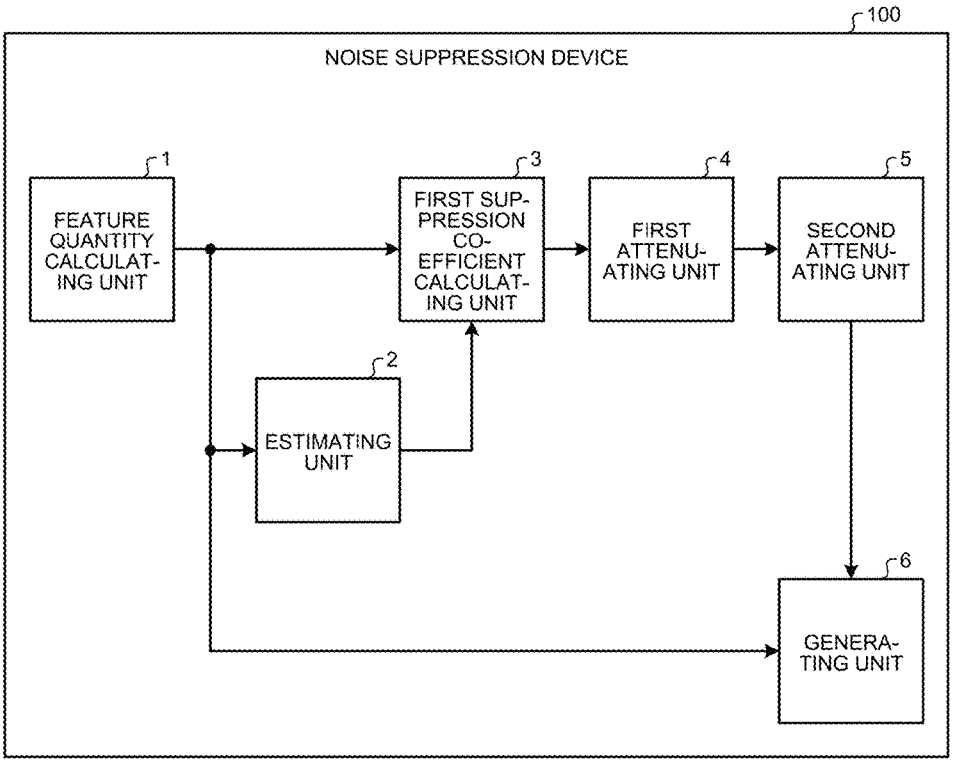
FIG. 1 is a diagram illustrating an exemplary functional configuration of a noise suppression device according to a first embodiment.

FIG. 1 is a diagram illustrating an exemplary functional configuration of a noise suppression device 100 according to a first embodiment. The noise suppression device 100 according to the first embodiment includes a feature quantity calculating unit 1, an estimating unit 2, a first suppression coefficient calculating unit 3, a first attenuating unit 4, a second attenuating unit 5, and a generating unit 6.

The feature quantity calculating unit 1 performs frequency analysis with respect to an acoustic signal representing a sound and calculates, for each frequency range of the acoustic signal, a feature quantity representing the feature of that acoustic signal. Herein, the size of the frequency range, which represents the unit of calculation for calculating the feature quantity, can be set in an arbitrary manner.

An acoustic signal is a digital signal sampled at, for example, 16 kHz. An acoustic signal not only includes a voice signal representing the voice of a user but also includes a noise signal representing the noise. The noise signal is generated depending on the following: the environment in which the user obtains a sound, the acoustic signal communication mechanism, and the device that processes the acoustic signal.

The method for obtaining acoustic signals can be any arbitrary method. For example, the noise suppression device 100 can obtain acoustic signals using a microphone. Alternatively, for example, the noise suppression device 100 can obtain acoustic signals by reading them from a memory device in which they are stored. Still alternatively, for example, the noise suppression device 100 can obtain acoustic signals by receiving them via a wired communication device or a wireless communication device.

The feature quantity calculating unit 1 calculates the feature quantity in the following manner, for example. Firstly, the feature quantity calculating unit 1 divides an acoustic signal into frames having intervals of 64 samples of the length of 128. Then, the feature quantity calculating unit 1 applies a window function to the frame at each timing. Examples of the window function include the Hanning window and the Hamming window. Subsequently, the feature quantity calculating unit 1 obtains, from the frame at each timing and having the window function applied thereto, a feature vector representing the frequency-related feature. More particularly, the scalar value of each component of the feature vector represents the feature quantity of the frequency range corresponding to that scalar value.

Meanwhile, the feature vector can be calculated as a feature vector of the spectral area that is obtained by performing Fourier transformation with respect to the sample series of each frame, or can be calculated as a feature vector of a cepstrum area such as an LPC cepstrum or MFCC.

The feature quantity calculating unit 1 inputs the feature quantity, which is calculated for each frequency range, to the estimating unit 2, the first suppression coefficient calculating unit 3, and the generating unit 6.

The estimating unit 2 receives the feature quantity calculated for each frequency range from the feature quantity calculating unit 1, and estimates the noise component of that feature quantity. The method for estimating the noise component can be any arbitrary method.

For example, under the assumption that the noise component remains constant without any change at each timing, the estimating unit 2 estimates the average value of feature quantities in a noise section as the noise component. Herein, for example, the noise section represents the section that is not detected as a voice section during voice section detection. Alternatively, for example, under the assumption that the noise component changes at each timing, the estimating unit 2 can use a Kalman filter and estimate the noise component at each timing. Still alternatively, the estimating unit 2 can obtain the weighted sum of the noise component estimated under the assumption that the noise component remains constant without any change at each timing and the noise component estimated under the assumption that the noise component changes at each timing, and can estimate the noise component. Herein, the method for assigning the weights can be any arbitrary method.

The estimating unit 2 inputs noise component information, which indicates the noise component, to the first suppression coefficient calculating unit 3.

The first suppression coefficient calculating unit 3 receives the feature quantity calculated for each frequency range from the feature quantity calculating unit 1, and receives the noise component information from the estimating unit 2. Then, from the feature quantity and the noise component, the first suppression coefficient calculating unit 3 calculates, for each frequency range, a first suppression coefficient to be used in suppressing the noise included in a first acoustic signal.

The first suppression coefficient is a coefficient to be multiplied to the feature quantity for the purpose of suppressing the noise. Herein, the method for deciding the first suppression coefficient can be any arbitrary method.

The first suppression coefficient represents, for example, a ratio M/X of a voice component M and a feature quantity X. Herein, for example, the first suppression coefficient calculating unit 3 implements the spectral subtraction method and subtracts the value of a noise component B from the feature quantity X, and estimates the voice component M=X−B. Alternatively, for example, the first suppression coefficient calculating unit 3 separately estimates the voice component M and the noise component B and, if M=X−B does not hold true, sets the first suppression component to M/(M+B).

Meanwhile, if the feature quantity calculating unit 1 not only has performed Fourier transformation but has also performed an operation of calculating the feature quantity representing a wider frequency range from the state in which frequency ranges are segmentalized using filtering, then the first suppression coefficient calculating unit 3 can again perform segmentalization. That is, the first suppression coefficient calculating unit 3 can perform inverse transformation of filtering to again segmentalize the frequency range, and then can calculate the first suppression coefficient using the segmentized voice component M and the segmentized noise component B.

The first suppression coefficient calculating unit 3 inputs the first suppression coefficient, which is calculated for each frequency range of an acoustic signal, to the first attenuating unit 4.

The first attenuating unit 4 receives the first suppression coefficient, which is calculated for each frequency range of the acoustic signal, from the first suppression coefficient calculating unit 3; attenuates the first suppression coefficient in the time domain; and calculates a second suppression coefficient for each frequency range of the acoustic signal. A specific example of the method of calculating a second suppression coefficient is described later. The first attenuating unit 4 then inputs the second suppression coefficient, which is calculated for each frequency range of the acoustic signal, to the second attenuating unit 5.

The second attenuating unit 5 receives the second suppression coefficient, which is calculated for each frequency range of the acoustic signal, from the first attenuating unit 4; attenuates each second suppression coefficient in the frequency domain; and calculates a third suppression coefficient for the frequency range of the acoustic signal. A specific example of the method of calculating a third suppression coefficient is described later. The second attenuating unit 5 then inputs the third suppression coefficient, which is calculated for each frequency range of the acoustic signal, to the generating unit 6.

The generating unit 6 receives the feature quantity, which is calculated for each frequency range of the acoustic signal, from the feature quantity calculating unit 1; receives the third suppression coefficient, which is calculated for each frequency range of the acoustic signal, from the second attenuating unit 5; and, from the feature quantity and the third suppression coefficient, generates an acoustic signal in which the noise is suppressed. More particularly, the generating unit 6 multiplies the feature quantity by the third suppression coefficient, and estimates the voice component of the feature quantity. Then, the generating unit 6 converts the estimated voice component into an acoustic signal, and thus generates the acoustic signal in which the noise is suppressed.

Examples of the operation of converting the estimated voice component into an acoustic signal include inverse Fourier transformation. Meanwhile, in order to maintain the continuity of acoustic signals, the generating unit 6 can perform an operation of applying a window function designed based on the Hanning window or the Hamming window, or can perform an operation of obtaining the sum of acoustic signals in each frame regarding the overlapping portion with the corresponding previous frame.

Given below is the explanation of a specific method for calculating a second suppression coefficient and a third suppression coefficient.

Figure 2:
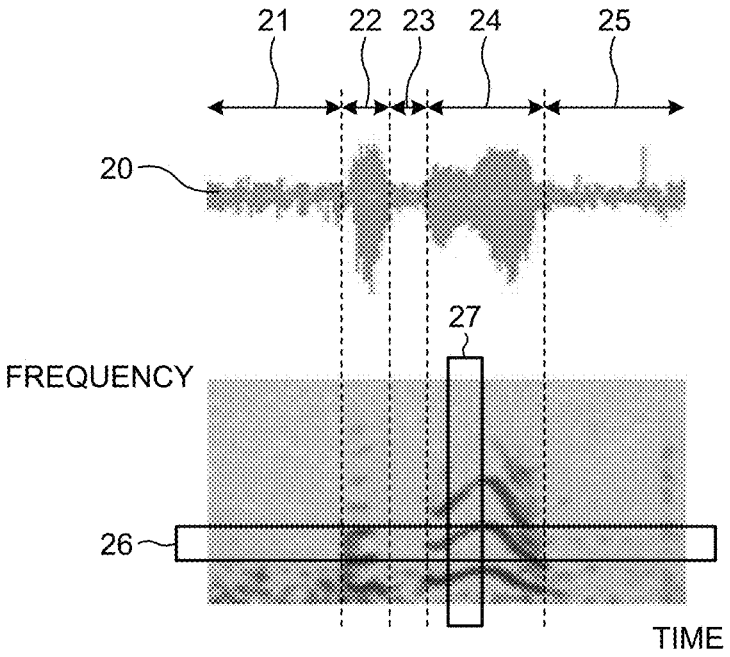
FIG. 2 is a diagram illustrating an example of an acoustic signal.

FIG. 2 is a diagram illustrating an example of an acoustic signal 20. In the example illustrated in the upper half of FIG. 2, the acoustic signal 20 includes a non-voice section 21, a voice section 22, a short pose 23, a voice section 24, and a non-voice section 25. In the lower half of FIG. 2, the acoustic signal 20 is expressed using frequency.

The first attenuating unit 4 treats the first suppression coefficient, which is calculated for each frequency range of the acoustic signal 20 by the first suppression coefficient calculating unit 3, as a function in time direction 26 and attenuates the first suppression coefficient in the time domain. The second attenuating unit 5 treats the second suppression coefficient, which is calculated from the first suppression coefficient by the first attenuating unit 4, as a function in frequency direction 27 and attenuates the second suppression coefficient in the frequency domain.

Firstly, the explanation is given about the method for calculating a second suppression coefficient.

Figure 3A:
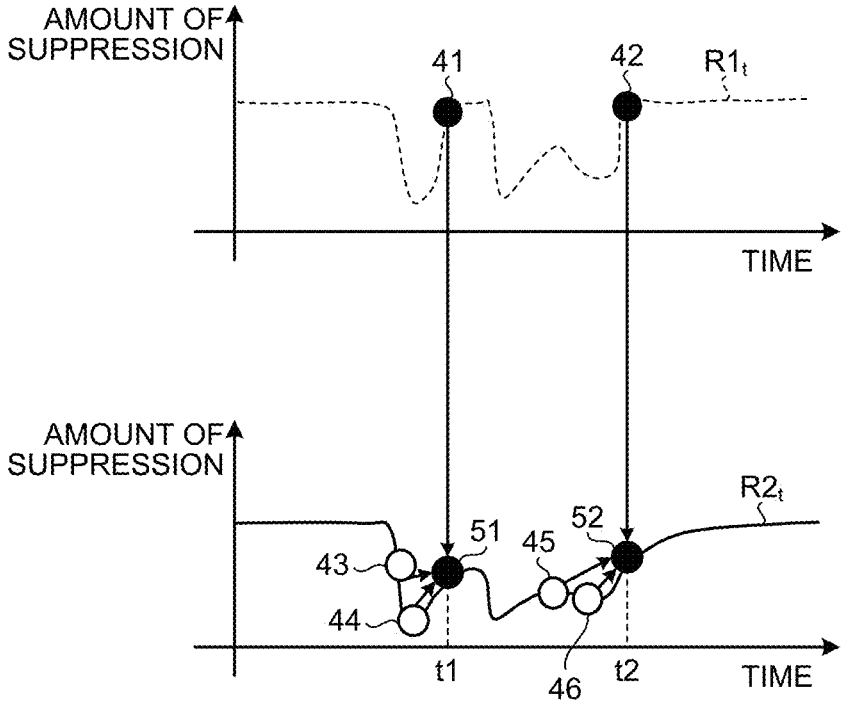
FIG. 3A is a conceptual diagram illustrating an example of the method for calculating a second suppression coefficient according to the first embodiment.

FIG. 3A is a conceptual diagram illustrating an example of the method for calculating a second suppression coefficient $R2_t$ according to the first embodiment. The first attenuating unit 4 calculates the second suppression coefficient $R2_t$ by attenuating a first suppression coefficient $R1_t$ that is calculated for each frequency range of the acoustic signal. In FIG. 3A is conceptually illustrated an example in which a point 51 representing the value of a second suppression coefficient $R2_{t1}$ is calculated based on a point 41 representing the value of a first suppression coefficient $R1_{t1}$ and based on the values of the second suppression coefficient $R2_t$ (for example, points 43 and 44) prior to a timing t1. Moreover, in FIG. 3A is conceptually illustrated an example in which a point 52 representing the value of a second suppression coefficient $R2_{t2}$ is calculated based on a point 42 representing the value of a first suppression coefficient $R1_{t2}$ and based on the values of the second suppression coefficient $R2_t$ (for example, points 45 and 46) prior to a timing t2.

More particularly, firstly, the first attenuating unit 4 calculates a weighted sum R2a of the second suppression coefficients $R2_t$ calculated in the previous N number of frames.

Herein, the method for calculating the weighted sum R2a can be any arbitrary method. For example, the first attenuating unit 4 can assign the weights in such a way that, the closer the frame of calculation of the second suppression coefficient $R2_t$ is to the target timing t for processing, the greater the assigned weight is.

Meanwhile, if the previous N number of frames required in calculating the weighted sum R2a are not present, the first attenuating unit 4 starts the operations from such a timing t from which the previous N number of frames can be obtained.

Moreover, the number N of frames used in calculating the weighted sum R2a can be any arbitrary number. For example, N=1 can be set, and the weighted sum R2a can be set to a second suppression coefficient $R2_{t-1}$ at the timing t−1. Moreover, according to the number of samples included in a single frame, the number N of frames used in calculating the weighted sum R2a can be varied. For example, the smaller is the number of samples included in a single frame, the greater can be the number N of frames used in calculating the weighted sum R2a.

Subsequently, the first attenuating unit 4 calculates a minimum value R1 min using the smaller value between the weighted sum R2a and the first suppression coefficient $R1_t$.

Then, based on the smaller value between the minimum value R1 min and the first suppression coefficient $R1_t$ at the target timing for processing, the first attenuating unit 4 calculates the second suppression coefficient $R2_t$ at the target timing for processing. For example, the first attenuating unit 4 calculates the second suppression coefficient $R2_t$ by obtaining a weighted sum according to Equation (1) given below.

$$\alpha R1\min+(1-\alpha)R1_t \tag{1}$$

Herein, the value α satisfies the range of $0<\alpha<1$. Moreover, the value α can be varied according to the number of samples included in a single frame. For example, the smaller is the number of samples included in a single frame, the greater can be the value α. In other words, the greater is the number of samples included in a single frame, the smaller can be the value α. With that, the greater is the number of samples included in a single frame, the smaller can be the attenuation amount set by the first attenuating unit 4 at the time of attenuating the first suppression coefficient $R1_t$ in the time domain. That enables achieving prevention from excessive attenuation.

Figure 3B:
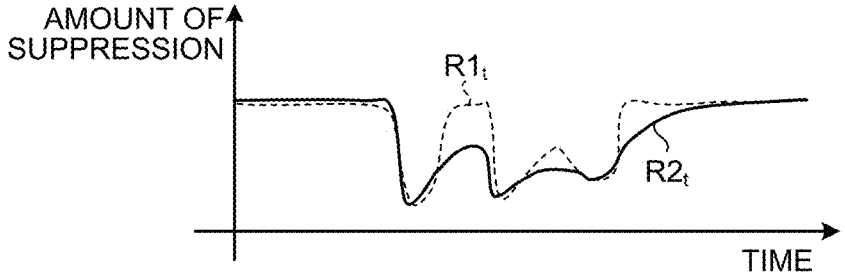
FIG. 3B is a comparative diagram for comparing a first suppression coefficient and a second suppression coefficient according to the first embodiment.

FIG. 3B is a comparative diagram for comparing the first suppression coefficient $R1_t$ and the second suppression coefficient $R2_t$ according to the first embodiment. Using the weighted sum obtained according to Equation (1) given earlier, the second suppression coefficient $R2_t$ is calculated to have a higher-attenuated value than the first suppression coefficient $R1_t$.

Given below is the explanation of a method for calculating a third suppression coefficient.

Figure 4A:
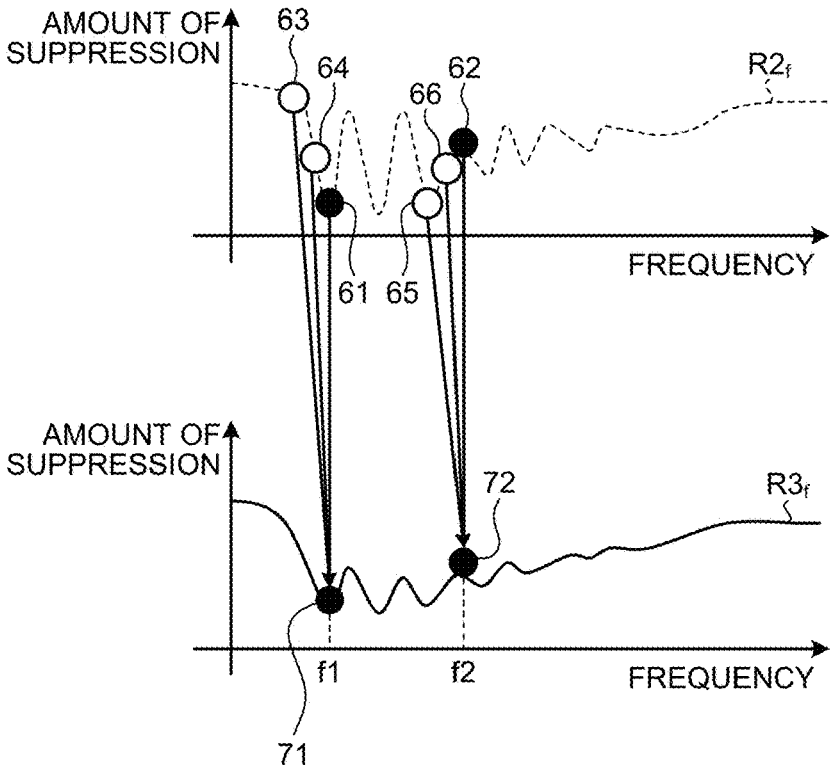
FIG. 4A is a conceptual diagram illustrating an example of the method for calculating a third suppression coefficient according to the first embodiment.

FIG. 4A is a conceptual diagram illustrating an example of the method for calculating a third suppression coefficient $R3_f$ according to the first embodiment. The second attenuating unit 5 converts, for each frequency range of the acoustic signal, the second suppression coefficient $R2_t$, which is calculated as a function of the time domain, into a second suppression coefficient $R2_f$ expressed as a function of the frequency domain; attenuates the second suppression coefficient $R2_f$; and calculates the third suppression coefficient $R3_f$. In FIG. 4A is conceptually illustrated an example in which a point 71 representing the value of a third suppression coefficient $R3_{f1}$ is calculated based on a point 61 representing the value of a second suppression coefficient $R2_{f1}$ and the values of the second suppression coefficient $R2_f$ around a frequency f1 (for example, points 63 and 64). In FIG. 4A is conceptually illustrated an example in which a point 72 representing the value of a third suppression coefficient $R3_{f2}$ is calculated based on a point 62 representing the value of a second suppression coefficient $R2_{f2}$ and the values of the second suppression coefficient $R2_f$ around a frequency f2 (for example, points 65 and 66).

More particularly, firstly, the second attenuating unit 5 calculates a weighted sum R2b of the second suppression coefficients $R2_f$ in the surrounding frequency ranges of a target frequency f for processing. For example, the second attenuating unit 5 calculates the weighted sum R2b of a second suppression coefficient $R2_{low}$, which is calculated in the $N_{low}$ number of frames on the low-frequency side of the frequency f, and a second suppression coefficient $R2_{high}$, which is calculated in the $N_{high}$ number of frames on the high-frequency side of the frequency f.

Herein, $N_{low}$ and $N_{high}$ can be set in an arbitrary manner. For example, in the example illustrated in the conceptual diagram in FIG. 4A, $N_{low}=2$ and $N_{high}=0$ is set. Moreover, the numbers $N_{low}$ and $N_{high}$ that are used in calculating the weighted sum R2b can be varied according to the number of samples included in a single frame. For example, the smaller is the number of samples, the greater can be the numbers $N_{low}$ and $N_{high}$ of frames used in calculating the weighted sum R2b.

Meanwhile, the method for calculating the weighted sum R2b can be any arbitrary method. For example, the second attenuating unit 5 can assign the weights in such a way that, the closer is the second suppression coefficient $R2_f$ to the target frequency f for processing, the greater is the assigned weight.

Subsequently, the second attenuating unit 5 calculates a minimum value R2 min using the smaller value between the weighted sum R2b and the second suppression coefficient $R2_f$.

Then, based on the smaller value between the minimum value R2 min and the second suppression coefficient $R2_f$ at the target frequency for processing, the second attenuating unit 5 calculates the third suppression coefficient $R3_f$ at the target frequency for processing. For example, the second attenuating unit 5 calculates the third suppression coefficient $R3_f$ by obtaining a weighted sum according to Equation (2) given below.

$$\beta R2\min+(1-\beta)R2_f \tag{2}$$

Herein, the value β satisfies the range of $0<\beta<1$. Moreover, the value β can be varied according to the number of samples included in a single frame. For example, the smaller is the number of samples included in a single frame, the greater can be the value β. In other words, the greater is the number of samples included in a single frame, the smaller can be the value β. With that, the greater is the number of samples included in a single frame, the smaller can be the attenuation amount set by the second attenuating unit 5 at the time of attenuating the second suppression coefficient $R2_f$ in the frequency domain. That enables achieving prevention from excessive attenuation.

Figure 4B:
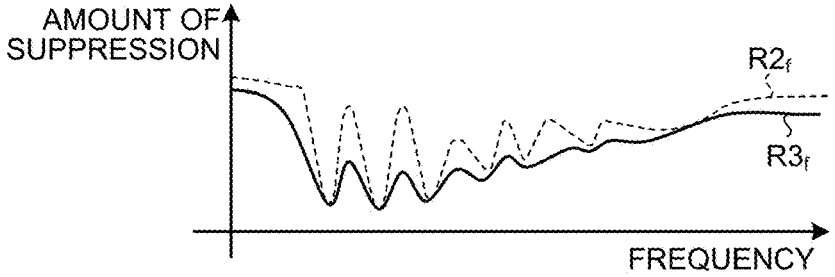
FIG. 4B is a comparative diagram for comparing a second suppression coefficient and a third suppression coefficient according to the first embodiment.

FIG. 4B is a comparative diagram for comparing the second suppression coefficient $R2_f$ and the third suppression coefficient $R3_f$ according to the first embodiment. Using the weighted sum according to Equation (2) given earlier, the third suppression coefficient $R3_f$ is calculated to have a higher-attenuated value than the second suppression coefficient $R2_f$.

Given below is the explanation of the effect of the noise suppression device 100 according to the first embodiment with reference to the example of the acoustic signal 20 illustrated in FIG. 2.

In the conventional noise suppression technology, for example, at the time of transition from the voice section 22 to the short pose 23 and at the time of transition from the voice section 24 to the non-voice section 25, if the first suppression coefficient $R1_t$ is amplified all of a sudden, although the amount of suppression of the noise is raised, it results in an unnatural sound. However, in a simple operation such as smoothing of the first suppression coefficient $R1_t$, if the initial first suppression coefficient $R1_t$ of the voice sections 22 and 24 is raised on the contrary, it results in the loss of the voice component of the acoustic signal 20.

In the noise suppression device 100 according to the first embodiment, as illustrated in FIG. 3A and FIG. 3B, since the second suppression coefficient $R2_t$ is attenuated based on the previous second suppression coefficients $R2_t$, no such amplification of the second suppression coefficient $R2_t$ is caused which would result in the loss of the voice component. Hence, the second suppression coefficient $R2_t$ can be varied smoothly. As a result, at the time of transition from the voice section 22 to the short pose 23 and at the time of transition from the voice section 24 to the non-voice section 25, it is possible to improve upon the unnatural sound.

Moreover, even the variation in the frequency axis direction leads to the deterioration in the naturalness of the post-noise-suppression acoustic signals. However, in the noise suppression device 100 according to the first embodiment, as illustrated in FIGS. 4A and 4B, since the third suppression coefficient $R3_f$ is attenuated based on the second suppression coefficient $R2_f$ in the surrounding frequency range, the naturalness of the post-noise-suppression acoustic signals can be improved without losing the voice component.

Given below is the explanation of an example of the noise suppression method according to the first embodiment.

Figure 5:
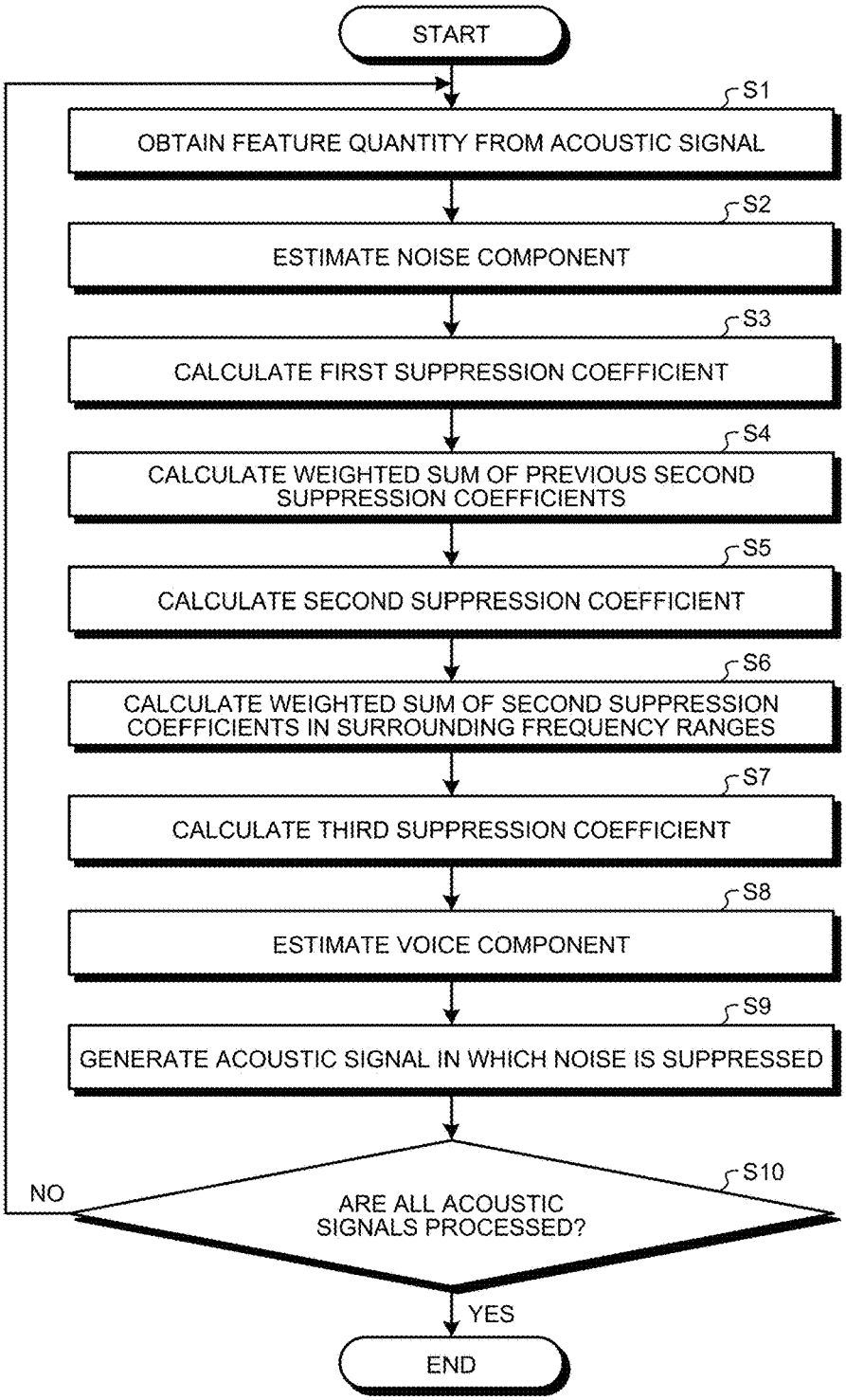
FIG. 5 is a flowchart for explaining an example of the noise suppression method according to the first embodiment.

FIG. 5 is a flowchart for explaining an example of the noise suppression method according to the first embodiment. Firstly, the feature quantity calculating unit 1 obtains the acoustic signal worth a single frame (for example, 128 samples) as the target acoustic signal for processing; and obtains the feature quantity, which represents the feature of that acoustic signal, for each frequency range of the acoustic signal (Step S1).

Then, the estimating unit 2 receives the feature quantity calculated for each frequency range from the feature quantity calculating unit 1, and estimates the noise component of that feature quantity (Step S2).

Subsequently, from the feature quantity calculated at Step S1 and the noise component estimated at Step S2, the first suppression coefficient calculating unit 3 calculates, for each frequency range, the first suppression coefficient $R1_t$ to be used in suppressing the noise included in a first acoustic signal (Step S3).

Then, the first attenuating unit 4 calculates the weighted sum R2a of the second suppression coefficients $R2_t$ calculated in the previous N number of frames (Step S4).

Subsequently, from the weighted sum R2a and the first suppression coefficient $R1_t$, the first attenuating unit 4 calculates the second suppression coefficient $R2_t$ for each frequency range of the acoustic signal (Step S5). More particularly, the first attenuating unit 4 calculates the minimum value R1 min using the smaller value between the weighted sum R2a and the first suppression coefficient $R1_t$. Then, the first attenuating unit 4 calculates the second suppression coefficient $R2_t$ by obtaining a weighted sum according to Equation (1) given earlier.

Subsequently, the second attenuating unit 5 calculates the weighted sum R2b of the second suppression coefficients $R2_f$ in the surrounding frequency ranges of the frequency f (Step S6). More particularly, for each frequency range of the acoustic signal, the second attenuating unit 5 converts the second suppression coefficient $R2_t$, which is calculated as a function of the time domain, into the second suppression coefficient $R2_f$ expressed as a function of the frequency domain. Then, the second attenuating unit 5 calculates the weighted sum R2b of the second suppression coefficient $R2_{low}$, which is calculated in the $N_{low}$ number of frames on the low-frequency side of the frequency f, and the second suppression coefficient $R2_{high}$, which is calculated in the $N_{high}$ number of frames on the high-frequency side of the frequency f.

Subsequently, from the weighted sum R2b and the second suppression coefficient $R2_f$, the second attenuating unit 5 calculates the third suppression coefficient $R3_f$ for each frequency range of the acoustic signal (Step S7). More particularly, the second attenuating unit 5 calculates the minimum value R2 min using the smaller value between the weighted sum R2b and the second suppression coefficient $R2_f$. Then, the second attenuating unit 5 calculates the third suppression coefficient $R3_f$ by obtaining a weighted sum according to Equation (2) given earlier.

Subsequently, from the feature quantity calculated for each frequency range of the acoustic signal at Step S1 and from the third suppression coefficient $R3_f$ calculated as a function of the frequency domain at Step S7, the generating unit 6 estimates the voice component of the feature quantity (Step S8). More particularly, the generating unit 6 converts the third suppression coefficient $R3_f$, which is calculated as a function of the frequency domain, into the third suppression coefficient $R3_t$ expressed as a function of the time domain. Then, the generating unit 6 multiplies the third suppression coefficient $R3_t$, which is calculated for each frequency range of the acoustic signal, by the feature quantity calculated for each frequency range of the acoustic signal at Step S1; and estimates the voice component of the feature quantity.

Subsequently, the generating unit 6 converts the voice component, which is estimated at Step S8, into an acoustic signal and thus generates the acoustic signal in which the noise is suppressed (Step S9). Then, the feature quantity calculating unit 1 determines whether or not all acoustic signals have been processed (Step S10). If all acoustic signals have not been processed (No at Step S10), then the system control returns to Step S1. When all acoustic signals are processed (Yes at Step S10), it marks the end of the operations.

As described above, in the noise suppression device 100 according to the first embodiment, from the feature quantity calculated by the feature quantity calculating unit 1 and the noise component estimated by the estimating unit 2, the first suppression coefficient calculating unit 3 calculates, for each frequency range, the first suppression coefficient $R1_t$ that is to be used in suppressing the noise included in the acoustic signal. The first attenuating unit 4 attenuates the first suppression coefficient $R1_t$ in the time domain, and calculates the second suppression coefficient $R2_t$. The second attenuating unit 5 attenuates the second suppression coefficient $R2_f$ in the frequency domain, and calculates the third suppression coefficient $R3_f$. Then, from the feature quantity and the third suppression coefficient $R3_t$, the generating unit 6 estimates the voice component of the feature quantity; and, from the estimated voice component, generates an acoustic signal in which the noise is suppressed.

As a result, in the noise suppression device 100 according to the first embodiment, it becomes possible to improve upon the excessive sound suppression, thereby enabling achieving prevention from the suppression of the voice component and enabling generation of easy-to-hear acoustic signals. For example, when the acoustic signals in which the noise has been suppressed by the noise suppression device 100 according to the first embodiment are input to a voice recognition device, it becomes possible to perform voice recognition after elimination of the influence of noise. Moreover, for example, at the time of performing voice communication using a cellular phone, as a result of reproducing the voice in which the noise has been suppressed by the noise suppression device 100 according to the first embodiment, it becomes possible to make the voice easy to hear.

Second Embodiment

Given below is the explanation of a second embodiment. From the noise suppression device 100 according to the first embodiment, the noise suppression device 100 according to the second embodiment differs in the way of further including a smoothing unit 7. In the explanation of the second embodiment, the explanation identical to that in the first embodiment is not repeated.

Figure 6:
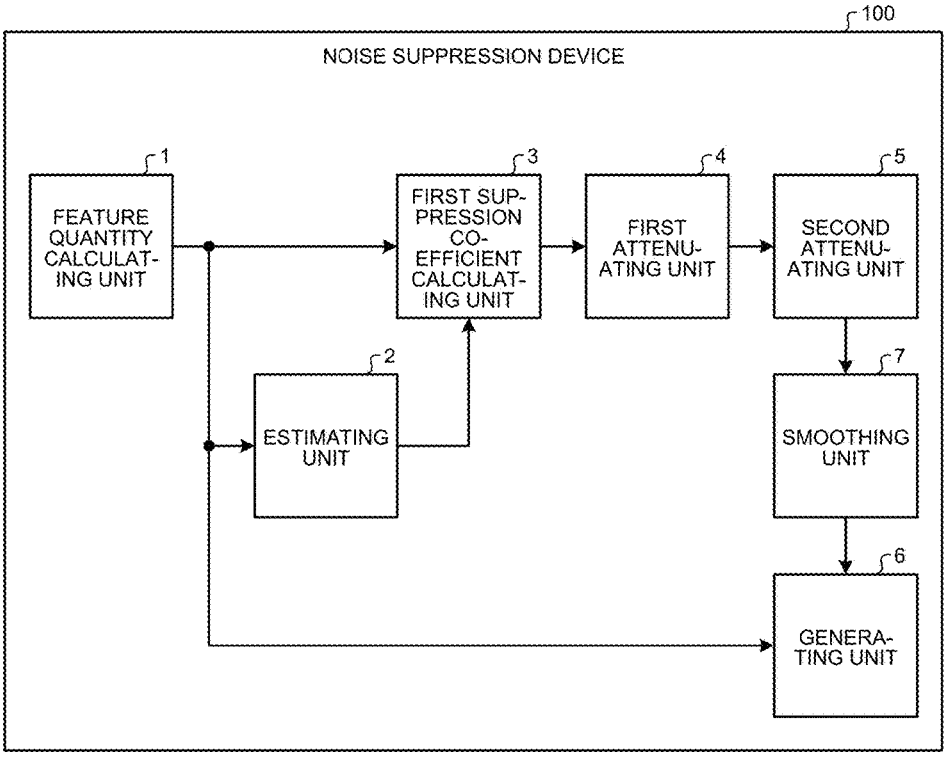
FIG. 6 is a diagram illustrating an exemplary functional configuration of the noise suppression device according to a second embodiment.

FIG. 6 is a diagram illustrating an exemplary functional configuration of the noise suppression device 100 according to the second embodiment. The noise suppression device 100 according to the second embodiment includes the feature quantity calculating unit 1, the estimating unit 2, the first suppression coefficient calculating unit 3, the first attenuating unit 4, the second attenuating unit 5, the generating unit 6, and the smoothing unit 7. The explanation about the operations performed by the feature quantity calculating unit 1, the estimating unit 2, the first suppression coefficient calculating unit 3, and the first attenuating unit 4 is identical to that given in the first embodiment, and is hence not repeated. The second attenuating unit 5 according to the second embodiment calculates the third suppression coefficient $R3_f$ by implementing the method identical to that implemented in the first embodiment, and inputs the third suppression coefficient $R3_f$ to the smoothing unit 7.

The smoothing unit 7 performs a time smoothing operation with respect to the third suppression coefficient $R3_t$ that is expressed as a function of the time domain (i.e., a smoothing operation in the time direction), and calculates a fourth suppression coefficient $R4_t$. Moreover, the smoothing unit 7 performs a frequency smoothing operation with respect to the third suppression coefficient $R3_f$ that is expressed as a function of the frequency domain (i.e., a smoothing operation in the frequency direction), and calculates a fourth suppression coefficient $R4_f$.

Herein, the time smoothing operation and the frequency smoothing operation can be performed in any sequence. Moreover, as long as at least either the time smoothing operation or the frequency smoothing operation is performed, it serves the purpose. Moreover, the number of times of performing the time smoothing operation and the frequency smoothing operation can be set in an arbitrary manner.

Firstly, given below is the specific explanation about the time smoothing operation. The smoothing unit 7 calculates a fourth suppression coefficient $R4_{t1}$ at the target timing t1 for processing using the weighted sum of a third suppression coefficient $R3_{t1}$ at the timing t1 and the third suppression coefficient $R3_t$ calculated at the timing t prior to the timing t1.

Herein, the method for assigning the weights can be any arbitrary method. For example, the smoothing unit 7 can assign the weights in such a way that, the closer the frame of calculation of the third suppression coefficient $R3_t$ is to the target timing t1 for processing, the greater the assigned weight is.

Meanwhile, instead of using the third suppression coefficient $R3_t$ calculated at the timing t prior to the target timing t1 for processing, the smoothing unit 7 can use the fourth suppression coefficient $R4_t$ calculated at the timing t prior to the target timing t1 for processing, and can calculate the fourth suppression coefficient $R4_{t1}$ at the timing t1.

Given below is the specific explanation of the frequency smoothing operation. The smoothing unit 7 calculates a fourth suppression coefficient $R4_{f1}$ at a target frequency f1 for processing using the weighted sum of a third suppression coefficient $R3_{f1}$ at the frequency f1 and the third suppression coefficients $R3_f$ at the frequencies f on the low-frequency side and the high-frequency side of the frequency f1.

Herein, the method for assigning the weights can be any arbitrary method. For example, the smoothing unit 7 can assign the weights in such a way that, the closer the frame of calculation of the third suppression coefficient $R3_f$ is to the target frequency f1 for processing, the greater the assigned weight is.

Meanwhile, instead of using the third suppression coefficients $R3_f$ calculated at the frequencies f on the low-frequency side and the high-frequency side of the target frequency f1 for processing, the smoothing unit 7 can use the fourth suppression coefficients $R4_f$ calculated at the frequencies f on the low-frequency side and the high-frequency side of the target frequency f1 for processing, and can calculate the fourth suppression coefficient $R4_{f1}$ at the frequency f1. Moreover, in the case of performing the frequency smoothing operation after the time smoothing operation, the smoothing unit 7 performs the frequency smoothing operation with respect to the fourth suppression coefficient $R4_f$ that is obtained by converting the fourth suppression coefficient $R4_t$, which is obtained as a result of performing the time smoothing operation, into a function of the frequency domain.

Given below is the explanation of an example of the noise suppression method according to the second embodiment.

Figure 7:
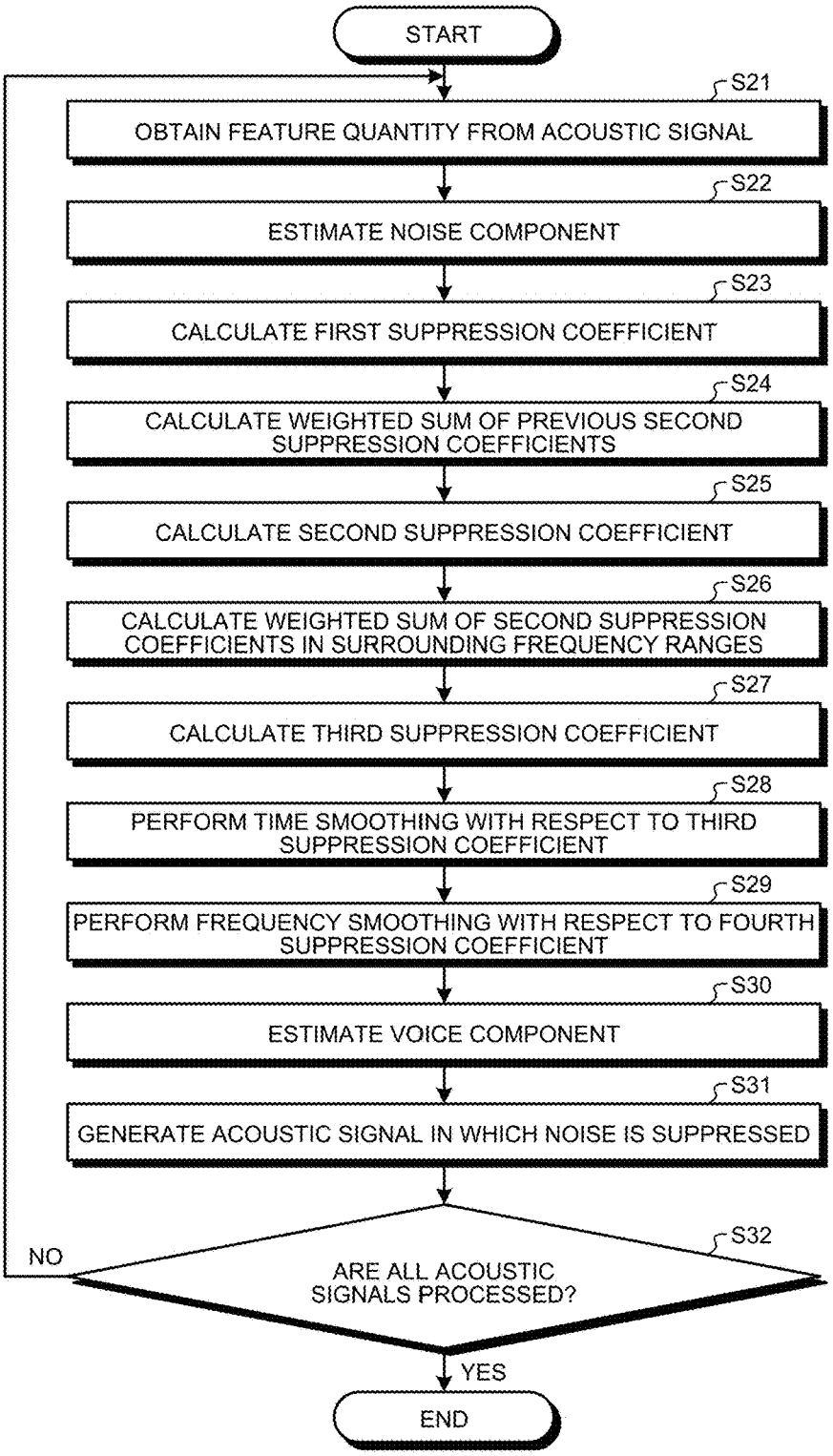
FIG. 7 is a flowchart for explaining an example of the noise suppression method according to the second embodiment.

FIG. 7 is a flowchart for explaining an example of the noise suppression method according to the second embodiment. The explanation of Steps S21 to S27 is identical to the explanation of Steps S1 to S7 (see FIG. 5) regarding the noise suppression method according to the first embodiment. Hence, that explanation is not repeated.

The smoothing unit 7 performs the time smoothing operation with respect to the third suppression coefficient $R3_t$ expressed as a function of the time domain, and calculates the fourth suppression coefficient $R4_t$ (Step S28).

Then, the smoothing unit 7 converts the fourth suppression coefficient $R4_t$, which is obtained at Step S28, into the fourth suppression coefficient $R4_f$ expressed as a function of the frequency domain, and performs the frequency smoothing operation with respect to the fourth suppression coefficient $R4_f$ (Step S29).

Then, from the feature quantity calculated for each frequency range of the acoustic signal at Step S21 and from the fourth suppression coefficient $R4_f$ calculated as a function of the frequency domain at Step S29, the generating unit 6 estimates the voice component of the feature quantity (Step S30). More particularly, the generating unit 6 converts the fourth suppression coefficient $R4_f$, which is calculated as a function of the frequency domain, into the fourth suppression coefficient $R4_t$ expressed as a function of the time domain. Then, the generating unit 6 multiplies the fourth suppression coefficient $R4_t$, which is calculated for each frequency range of the acoustic signal, by the feature quantity calculated for each frequency range of the acoustic signal at Step S21, and estimates the voice component of the feature quantity.

The explanation of Steps S31 and S32 is identical to the explanation of Steps S9 and S10 (see FIG. 5) regarding the noise suppression method according to the first embodiment. Hence, that explanation is not repeated.

As described above, in the noise suppression device 100 according to the second embodiment, the smoothing unit 7 at least either performs the smoothing operation in the time direction or performs the smoothing operation in the frequency direction, and thus calculates the fourth suppression coefficient $R4_t$. Then, from the feature quantity of the acoustic signal and the fourth suppression coefficient $R4_t$, the generating unit 6 estimates the voice component of the feature quantity of the acoustic signal; and, from the estimated voice component, generates an acoustic signal in which the noise is suppressed.

As a result, in the noise suppression device 100 according to the second embodiment, the fourth suppression coefficient $R4_t$ (the fourth suppression coefficient $R4_f$) undergoes changes in the time direction (the frequency direction) more smoothly. Hence, in addition to achieving the effect of the noise suppression device 100 according to the first embodiment, it becomes possible to generate an acoustic signal having a higher degree of naturalness.

Lastly, the explanation is given about a hardware configuration of the noise suppression device 100 according to the first and second embodiments.

Figure 8:
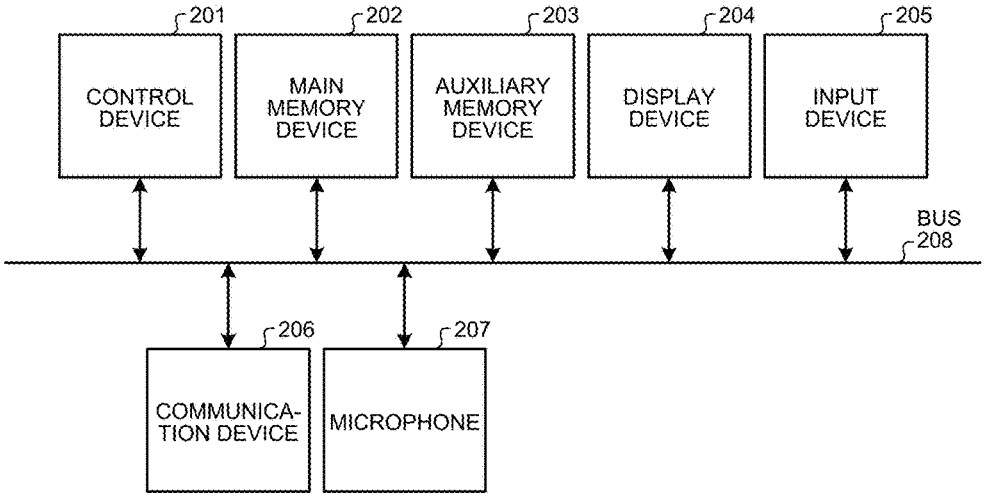
FIG. 8 is a diagram illustrating an exemplary hardware configuration of the noise suppression device according to the first and second embodiments.

FIG. 8 is a diagram illustrating an exemplary hardware configuration of the noise suppression device 100 according to the first and second embodiments. The noise suppression device 100 according to the first and second embodiments includes a control device 201, a main memory device 202, an auxiliary memory device 203, a display device 204, an input device 205, a communication device 206, and a microphone 207. Herein, the control device 201, the main memory device 202, the auxiliary memory device 203, the display device 204, the input device 205, the communication device 206, and the microphone 207 are connected to one another via a bus 208.

The control device 201 executes computer programs that are read from the auxiliary memory device 203 into the main memory device 202. The main memory device 202 is a memory such as a read only memory (ROM) or a random access memory (RAM). The auxiliary memory device 203 is a memory card or a solid state drive (SSD).

The display device 204 is used to display information. Examples of the display device 204 include a liquid crystal display. The input device 205 receives input of information. Examples of the input device 205 include a keyboard and a mouse. Meanwhile, the display device 204 and the input device 205 can be configured as a liquid crystal touch-sensitive panel having the display function as well as the input function. The communication device 206 performs communication with other devices. The microphone 207 obtains the surrounding sounds.

The computer programs executed in the noise suppression device 100 according to the first and second embodiments are stored as installable or executable files in a computer-readable memory medium such as a compact disk read only memory (CD-ROM), a memory card, a compact disk recordable (CD-R), or a digital versatile disk (DVD); and are provided as a computer program product.

Alternatively, the computer programs executed in the noise suppression device 100 according to the first and second embodiments can be stored in a downloadable manner in a computer connected to a network such as the Internet. Still alternatively, the computer programs executed in the noise suppression device 100 according to the first and second embodiments can be non-downloadably distributed over a network such as the Internet.

Still alternatively, the computer programs executed in the noise suppression device 100 according to the first and second embodiments can be stored in advance in a ROM.

The computer programs executed in the noise suppression device 100 according to the first and second embodiments contain modules of such functions, from among the functional configuration of the noise suppression device 100 according to the first and second embodiments, which can be implemented using computer programs.

Regarding a function to be implemented using a computer program, the control device 201 reads a computer program from a memory medium such as the auxiliary memory device 203 and executes the computer program so that the function to be implemented using that computer program is loaded in the main memory device 202. That is, the function to be implemented using that computer program is generated in the main memory device 202.

Meanwhile, some or all of the functions of the noise suppression device 100 according to the first and second embodiments can alternatively be implemented using hardware such as an integrated circuit (IC).

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A noise suppression device comprising:

an estimating unit that estimates, from a feature quantity representing a feature in each frequency range of a first acoustic signal which represents sound, a noise component of the feature quantity;

a calculating unit that calculates, from the feature quantity and the noise component for each frequency range, a first suppression coefficient to be used in suppressing noise included in the first acoustic signal;

a first attenuating unit that attenuates the first suppression coefficient in time domain to calculate a second suppression coefficient;

a second attenuating unit that attenuates the second suppression coefficient in frequency domain to calculate a third suppression coefficient; and a generating unit that estimates, from the feature quantity and the third suppression coefficient, a voice component of the feature quantity and generates, from the estimated voice component, a second acoustic signal in which noise included in the first acoustic signal is suppressed.

2. The noise suppression device according to claim 1, wherein the first attenuating unit calculates the second suppression coefficient at target timing for processing based on smaller value between a weighted sum of the second suppression coefficients calculated prior to the target timing for processing and the first suppression coefficient at the target timing for processing.

3. The noise suppression device according to claim 1, wherein, the greater is a number of samples included in a frame of the first acoustic signal used in calculating the feature quantity, the smaller is an attenuation amount set by the first attenuating unit at time of attenuating the first suppression coefficient in time domain.

4. The noise suppression device according to claim 1, wherein the second attenuating unit calculates the third suppression coefficient at target frequency for processing based on smaller value between a weighted sum of the second suppression coefficients calculated in surrounding frequency ranges of the target frequency for processing and the second suppression coefficient at the target frequency for processing.

5. The noise suppression device according to claim 1, wherein, the greater is a number of samples included in a frame of the first acoustic signal used in calculating the feature quantity, the smaller is an attenuation amount set by the second attenuating unit at time of attenuating the second suppression coefficient in frequency domain.

6. The noise suppression device according to claim 1, further comprising a smoothing unit that at least either performs a smoothing operation in a time direction or performs a smoothing operation in a frequency direction with respect to the third suppression coefficient and calculates a fourth suppression coefficient, wherein the generating unit estimates, from the feature quantity and the fourth suppression coefficient, the voice component of the feature quantity and generates, from the estimated voice component, a second acoustic signal in which noise included in the first acoustic signal is suppressed.

7. The noise suppression device according to claim 1, further comprising a feature quantity calculating unit that performs frequency analysis with respect to the first acoustic signal and calculates the feature quantity in each frequency range of the first acoustic signal.

8. A noise suppression method employed in a noise suppression device comprising:

estimating, from a feature quantity representing a feature in each frequency range of a first acoustic signal which represents sound, a noise component of the feature quantity;

calculating, from the feature quantity and the noise component, for each frequency range, a first suppression coefficient to be used in suppressing noise included in the first acoustic signal;

calculating a second suppression coefficient by attenuating the first suppression coefficient in time domain;

calculating a third suppression coefficient by attenuating the second suppression coefficient in frequency domain; and estimating, from the feature quantity and the third suppression coefficient, a voice component of the feature quantity and generating, from the estimated voice component, a second acoustic signal in which noise included in the first acoustic signal is suppressed.

9. A computer program product having a non-transitory computer readable medium including programmed instructions, wherein the instructions, when executed by a computer, cause the computer to function as:

an estimating unit that estimates, from a feature quantity representing a feature in each frequency range of a first acoustic signal which represents sound, a noise component of the feature quantity;

a calculating unit that calculates, from the feature quantity and the noise component for each frequency range, a first suppression coefficient to be used in suppressing noise included in the first acoustic signal;

a first attenuating unit that attenuates the first suppression coefficient in time, domain to calculate a second suppression coefficient;

a second attenuating unit that attenuates the second suppression coefficient in frequency domain to calculate a third suppression coefficient; and a generating unit that estimates, from the feature quantity and the third suppression coefficient, a voice component of the feature quantity and generates, from the estimated voice component, a second acoustic signal in which noise included in the first acoustic signal is suppressed.

* * * * *